US010197309B2

(12) United States Patent
Tao et al.

(10) Patent No.: US 10,197,309 B2
(45) Date of Patent: Feb. 5, 2019

(54) COLD END HEAT EXCHANGING DEVICE AND SEMICONDUCTOR REFRIGERATOR

(71) Applicant: Qingdao Haier Joint Stock Co., Ltd., Qingdao (CN)

(72) Inventors: Haibo Tao, Qingdao (CN); Dong Yu, Qingdao (CN); Peng Li, Qingdao (CN); Jianru Liu, Qingdao (CN); Dingyuan Wang, Qingdao (CN); Chunyang Li, Qingdao (CN); Feifei Qi, Qingdao (CN); Lisheng Ji, Qingdao (CN)

(73) Assignee: QINGDAO HAIER JOINT STOCK CO., LTD, Qingdao (CN)

( * ) Notice: Subject to any disclaimer, the term of this patent is extended or adjusted under 35 U.S.C. 154(b) by 0 days.

(21) Appl. No.: 15/536,512

(22) PCT Filed: Sep. 28, 2015

(86) PCT No.: PCT/CN2015/090985
§ 371 (c)(1),
(2) Date: Jun. 15, 2017

(87) PCT Pub. No.: WO2016/095587
PCT Pub. Date: Jun. 23, 2016

(65) Prior Publication Data

US 2017/0328611 A1 Nov. 16, 2017

(30) Foreign Application Priority Data

Dec. 15, 2014 (CN) ..... 2014 1 0777708

(51) Int. Cl.
*F25B 21/02* (2006.01)
*F25D 19/00* (2006.01)
(Continued)

(52) U.S. Cl.
CPC ..... *F25B 21/02* (2013.01); *F25D 11/00* (2013.01); *F25D 16/00* (2013.01); *F25D 17/02* (2013.01);
(Continued)

(58) Field of Classification Search
CPC .. F25B 21/02; F25B 2321/0252; F25D 11/00; F25D 16/00; F25D 17/02; F28D 15/0275
See application file for complete search history.

(56) References Cited

U.S. PATENT DOCUMENTS 3,181,310 A * 5/1965 Ammons ..... F25D 11/006 62/432
5,653,111 A * 8/1997 Attey ..... F04D 13/0673 165/170
(Continued)

FOREIGN PATENT DOCUMENTS

CN 2472155 Y 1/2002
CN 2906522 Y 5/2007
(Continued)

OTHER PUBLICATIONS

International Search Report and Written Opinion from International Patent Application No. PCT/CN2015/090985, with English translations, dated Dec. 15, 2015, 6 pages.

*Primary Examiner* — Travis Ruby
(74) *Attorney, Agent, or Firm* — Alston & Bird LLP

(57) ABSTRACT

A cold end heat exchanging device and a semiconductor refrigerator having the cold end heat exchanging device. The cold end heat exchanging device comprises a cold end heat exchanging part and a plurality of refrigerant pipelines. The cold end heat exchanging part defines an inner cavity or a conduit for containing a gas-phase and liquid-phase co-existing refrigerant. Each refrigerant pipeline is provided with an evaporation section that is downwards bent and extends in a vertical plane and has a closed tail end, and a
(Continued)

connection section that is upwards bent and extends from a starting end of the evaporation section and is connected to the inner cavity or the conduit. Evaporation sections of at least some refrigerant pipelines of the plurality of refrigerant pipelines are distributed in two vertical planes that are perpendicular to each other.

8 Claims, 7 Drawing Sheets

(51) Int. Cl.
*F25D 11/00* (2006.01)
*F25D 16/00* (2006.01)
*F25D 17/02* (2006.01)

(52) U.S. Cl.
CPC ..... *F25D 19/00* (2013.01); *F25B 2321/0252* (2013.01)

(56) References Cited

U.S. PATENT DOCUMENTS 6,658,857 B1 * 12/2003 George ..... F25B 21/04 165/121
6,776,220 B1 * 8/2004 Low ..... B64G 1/506 165/104.33
2001/0023762 A1 * 9/2001 Sagal ..... F28D 15/0233 165/185
2001/0039802 A1 * 11/2001 Barrash ..... F25B 9/14 62/6
2003/0029174 A1 * 2/2003 Lee ..... F24F 5/0042 62/3.6
2010/0154452 A1 * 6/2010 McCann ..... A23B 4/066 62/247
2013/0291559 A1 * 11/2013 June ..... F25B 21/00 62/3.2
2013/0291563 A1 * 11/2013 Edwards ..... F25B 21/02 62/3.3
2015/0075184 A1 * 3/2015 Edwards ..... F25B 21/02 62/3.2

FOREIGN PATENT DOCUMENTS

CN 202229500 U 5/2012
CN 203810826 U 9/2014
CN 104534781 A 4/2015

* cited by examiner

COLD END HEAT EXCHANGING DEVICE AND SEMICONDUCTOR REFRIGERATOR

CROSS-REFERENCE TO RELATED APPLICATIONS

This application is a national phase entry of International Application No. PCT/CN2015/090985, filed Sep. 28, 2015, which claims priority to Chinese Application No. 201410777708.8, filed Dec. 15, 2014, the entire contents of which are incorporated herein by reference.

TECHNICAL FIELD

The present invention relates to a refrigeration apparatus and, more particularly, to a cold end heat exchanging device and a semiconductor refrigerator having the cold end heat exchanging device.

BACKGROUND OF THE INVENTION

A semiconductor refrigerator is also known as a thermoelectric refrigerator. A semiconductor refrigerator uses a semiconductor cooler to achieve refrigeration by means of heat dissipation and conduction technologies through efficient annular double-layer heat pipes and automatic variable pressure and flow control technology, without the need of any refrigeration medium and mechanical moving components, and solves the problems in applications of traditional mechanical refrigerators, such as pollution from media and mechanical vibration.

However, the semiconductor refrigerator has to effectively transfer the temperature at the cold end of the semiconductor cooler into the storage compartment of the refrigerator. The prior art generally uses a heat radiator for forced convection, which is in direct contact with the cold end of the semiconductor cooler and exchanges heat with the storage compartment. The heat conduction and exchange efficiency between solid bodies is low, and is not conducive to the optimal performance of the semiconductor. The heat dissipation fins are bulky and take up much space in the refrigerator, and when combined with a fan, the noise is increased and the continuous operation of the fan reduces its reliability.

SUMMARY OF THE INVENTION

An object of a first aspect of the present invention is to provide a cold end heat exchanging device having high heat exchange efficiency and small occupied space.

A further object of the first aspect of the present invention is to maximize the effective evaporation area of the cold end heat exchanging device.

A still further object of the first aspect of the present invention is to make the production and assembling processes of the cold end heat exchanging device simple and reliable, and to fit the cold end heat exchanging device with the refrigerator body reliably and stably.

An object of a second aspect of the present invention is to provide a semiconductor refrigerator having the aforementioned cold end heat exchanging device.

According to the first aspect of the present invention, there is provided a cold end heat exchanging device for a semiconductor refrigerator. The cold end heat exchanging device comprises: a cold end heat exchanging part. which defines an inner cavity or conduit for containing a refrigerant existing in both gas and liquid phases and is configured to allow the refrigerant to flow therein and undergo phase-change heat exchange; and a plurality of refrigerant pipelines configured to allow the refrigerant to flow therein and undergo phase-change heat exchange, each of the refrigerant pipelines being provided with: an evaporation section which is downwardly bent and extends in a vertical plane and has a closed tail end, and a connection section which is upwardly bent and extends from a starting end of the evaporation section and is connected to the inner cavity or conduit. Particularly, the evaporation sections of at least some of the plurality of refrigerant pipelines being arranged in two vertical planes which are perpendicular to each other.

Optionally, the cold end heat exchanging part has a flat rectangular cuboid shape with the areas of a front surface and a rear surface opposite each other being larger than the areas of other surfaces, and the rear surface of the cold end heat exchanging part serves as a heat exchange surface which is thermally connected to a cold source.

Optionally, the two vertical planes include a first plane perpendicular to the rear surface of the cold end heat exchanging part, and a second plane parallel to the rear surface of the cold end heat exchanging part.

Optionally, the evaporation sections of some of the plurality of refrigerant pipelines are arranged in a third plane parallel to the first plane.

Optionally, the evaporation section of each of the refrigerant pipelines, of which the evaporation sections are arranged in the second plane, is located between the first plane and the third plane;

and the evaporation section of each of the refrigerant pipelines, of which the evaporation sections are arranged in the first plane, and the evaporation section of each of the refrigerant pipelines, of which the evaporation sections are arranged in the third plane, are both located on one side of the second plane.

Optionally, the number of refrigerant pipelines, of which the evaporation sections are arranged in the second plane, is two, and the refrigerant pipelines are symmetrically arranged with respect to a vertical geometrical symmetry plane.

Optionally, the number of refrigerant pipelines, of which the evaporation sections are arranged in the first plane, and the number of refrigerant pipelines, of which the evaporation sections are arranged in the third plane, are both one, and the refrigerant pipelines are symmetrically arranged with respect to the vertical geometrical symmetry plane.

Optionally, the evaporation section of each of the refrigerant pipelines, of which the evaporation sections are arranged in the second plane, has a projected length on a horizontal plane that is smaller than ½ of the width of a rear wall of a liner of the semiconductor refrigerator and greater than ¼ of the width of the rear wall of the liner;

the evaporation section of each of the refrigerant pipelines, of which the evaporation sections are arranged in the first plane, and the evaporation section of each of the refrigerant pipelines, of which the evaporation sections are arranged in the third plane, both have a projected length on a horizontal plane that is smaller than the width of a side wall of the liner of the semiconductor refrigerator and greater than ½ of the width of the side wall of the liner.

Optionally, the evaporation section of each of the refrigerant pipelines comprises:

a plurality of straight pipe segments disposed in the vertical direction at intervals, each of the straight pipe segments being arranged obliquely at an angle of 10° to 70° with respect to the horizontal plane; and bent segments, each connecting two adjacent straight pipe segments.

Optionally, the cold end heat exchanging device further comprises: a plurality of retention steel wires disposed in the vertical direction; and a pipe wall at an outer vertex of each of the bent segments on the same side of each of the refrigerant pipelines is welded to one of the retention steel wires.

According to the second aspect of the present invention, there is provided a semiconductor refrigerator. The semiconductor refrigerator comprises: a liner having a storage compartment defined therein; a semiconductor cooler disposed behind the liner; and any one of the aforementioned cold end heat exchanging devices, which is mounted such that the rear surface of the cold end heat exchanging part thereof is thermally connected to a cold end of the semiconductor cooler, and the evaporation section of each of the refrigerant pipelines is abutted against an outer surface of the inner for transferring the cold from the cold end to the storage compartment.

In the cold end heat exchanging device and the semiconductor refrigerator of the present invention, the evaporation sections of at least some of the plurality of refrigerant pipelines are arranged in the two vertical planes which are perpendicular to each other, the effective evaporation area of the cold end heat exchanging device is significantly improved, at least one side wall and a rear wall of a liner can perform heat exchange with the evaporation sections of the refrigerant pipelines, so that the cold dissipation efficiency of the cold end heat exchanging device and the energy efficiency of the semiconductor refrigerator are improved; and the cold end heat exchanging device makes full use of the refrigerator structure, and takes up small space.

Further, in the cold end heat exchanging device and the semiconductor refrigerator of the present invention, one end of each of the refrigerant pipelines is connected to the cold end heat exchanging part and is obliquely downwardly bent and extends, the use of phase-change circulation heat exchange of the refrigerant in the cold end heat exchanging part and the plurality of refrigerant pipelines effectively conducts the temperature of the cold end of the semiconductor cooler, and the use of the plurality of separate refrigerant pipelines makes the processing technology more convenient and facilitate the fitting with the refrigerator structure.

The foregoing and other objects, advantages and features of the present invention will become more apparent to those skilled in the art from the following detailed description of specific embodiments of the invention taken in conjunction with the accompanying drawings.

BRIEF DESCRIPTION OF THE DRAWINGS

Some specific embodiments of the present invention will be described in detail by way of example only rather than by way of limitation with reference to the accompanying drawings. The same reference numerals in the accompanying drawings denote the same or similar components or parts. It should be understood by those skilled in the art that these drawings are not necessarily to scale. In the accompanying drawings.

DETAILED DESCRIPTION OF THE INVENTION

Figure 1:
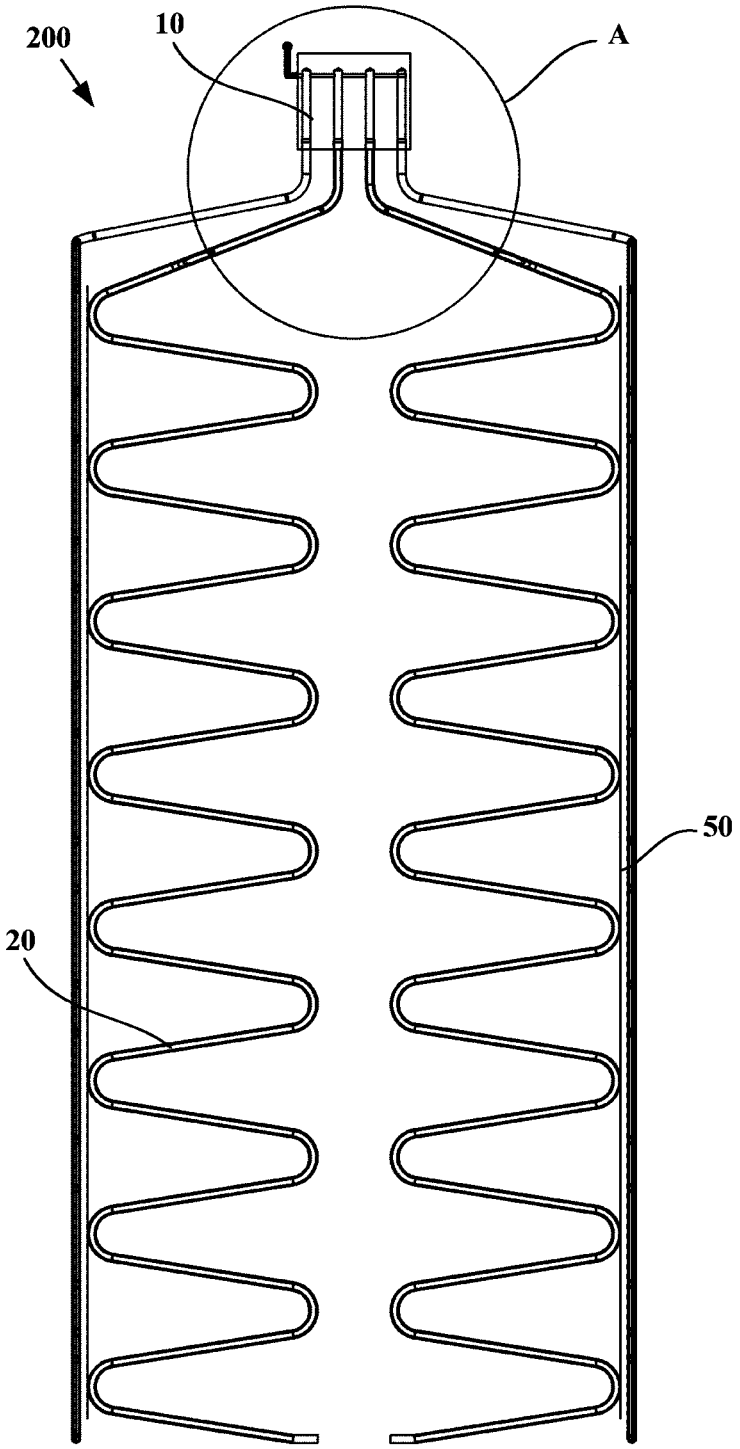
FIG. 1 is a schematic rear view of a cold end heat exchanging device according to one embodiment of the present invention.

The embodiments of the present invention will be described below in detail, and the examples of embodiments are shown in the drawings. The embodiments described below with reference to the drawings are exemplary and are merely used to explain the present invention, and cannot be interpreted as a restriction on the present invention. In the description of the present invention, the azimuth or positional relationship indicated by the terms "upper", "lower", "front", "rear" and the like is based on the azimuth or positional relationship shown in the drawings only for the purpose of facilitating the description of the invention, rather than requiring that the present invention must be constructed and operated in the particular azimuth, and therefore cannot be construed as limiting the present invention.

Figure 2:
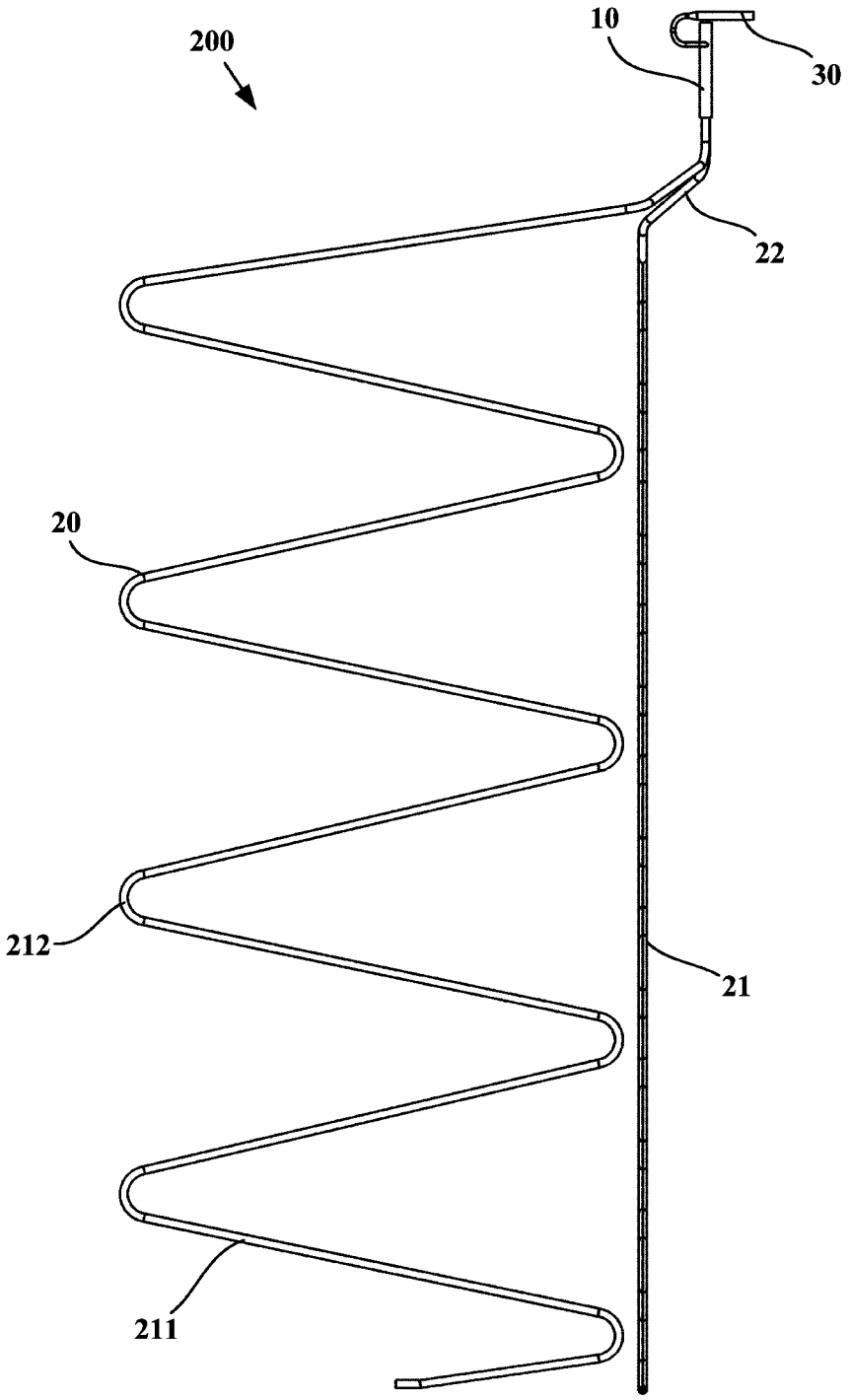
FIG. 2 is a schematic right view of a cold end heat exchanging device according to one embodiment of the present invention.

FIG. 1 is a schematic rear view of a cold end heat exchanging device 200 according to one embodiment of the present invention. As shown in FIG. 1, and with reference to FIGS. 2 and 3, the embodiments of the present invention provide a cold end heat exchanging device 200 for a semiconductor refrigerator, which may include a cold end heat exchanging part 10 and a plurality of refrigerant pipelines 20. Specifically, the cold end heat exchanging part 10 defines an inner cavity or conduit for containing a refrigerant existing in both gas and liquid phases and is configured to allow the refrigerant to flow therein and undergo phase-change heat exchange. The plurality of refrigerant pipelines 20 are configured to allow the refrigerant to flow therein and undergo phase-change heat exchange. Each of the refrigerant pipelines 20 is provided with: an evaporation section 21 which is downwardly bent and extends in a vertical plane and has a closed tail end, and a connection section 22 which is upwardly bent and extends from a starting end of the evaporation section 21 and is connected to the inner cavity or conduit. That is to say, the first end of each refrigerant pipeline 20 forming the opening end is connected to the lower portion of the inner cavity or conduit, and each refrigerant pipeline 20 obliquely downwardly bent and extends from the first end thereof and terminates at the second end forming the closed end. Particularly, evaporation sections 21 of at least some refrigerant pipelines 20 of the plurality of refrigerant pipelines 20 are arranged in the two vertical planes which are perpendicular to each other, at least one side wall and a rear wall of a liner 100 can perform heat exchange with the evaporation sections 21 of the refrigerant pipelines 20, so that the cold dissipation efficiency of the cold end heat exchanging device 200 and the energy efficiency of the semiconductor refrigerator are significantly improved. and the cold end heat exchanging device makes full use of the refrigerator structure, and takes up small space.

In some embodiments of the present invention, the refrigerant poured into the cold end heat exchanging part 10 and the refrigerant pipelines 20 may be carbon dioxide or other refrigeration medium, and the pouring amount of the refrigerant may be measured by a test. The downwardly and extending structure of each of the refrigerant pipelines 20 should ensure that the liquid refrigerant can be free to flow in the pipeline by gravity. When the cold end heat exchanging device 200 of the present embodiment works, the refrigerant is subjected to a gas-liquid phase change in the cold end heat exchanging part 10 and the refrigerant pipeline 20 for thermal cycling.

The cold end heat exchanging part 10 of the cold end heat exchanging device 200 may have a flat rectangular cuboid shape, and the areas of a front surface and a rear surface, disposed opposite to each other, of the cold end heat exchanging part 10 is larger than the areas of the other surfaces, and the rear surface of the cold end heat exchanging part 10 is used as a heat transfer surface which is thermally connected to a cold source (e.g., the cold end of a semiconductor cooler), the thermal connection may be such that the outer surface is in direct contact with and abutted against the cold source or in contact with same via a thermally conductive layer, wherein the thermally conductive layer may be thermally conductive silica gel or graphite or the like coated between the outer surface and the cold source. The "thermal connection" or "thermal contact" in the present embodiment may be direct abutting and contact, and the heat transfer is carried out by means of heat conduction. If the abutted contact surface is coated with thermally conductive silicone grease (graphite or other medium), it may be considered to be part of the abutted contact surface as a thermally conductive layer for improving the thermal connection (or thermal contact).

The evaporation sections 21 of at least some refrigerant pipelines 20 of the plurality of refrigerant pipelines 20 are arranged in two vertical planes perpendicular to each other, wherein the two vertical planes include a first plane perpendicular to the rear surface of the cold end heat exchanging part 10 and a second plane parallel to the rear surface of the cold end heat exchanging part 10, so that at least one side wall and a rear wall of the liner 100 perform heat exchange with the evaporation sections 21 of the refrigerant pipelines 20.

The cold end heat exchanging part 10 of the cold end heat exchanging device 200 may be disposed between the rear wall of the liner 100 and the back 310 of a housing when the cold end heat exchanging device 200 of the embodiment of the present invention is applied to the semiconductor refrigerator. For example, a distance may be provided between the front surface of the cold end heat exchanging part 10 and the rear wall of the liner 100 to ensure that the heat is not conducted to the liner 100 during a power failure or an operational failure, causing an abnormal temperature. The rear surface of the cold end heat exchanging part 10 is abutted against the cold end of the semiconductor cooler, and the evaporation section 21 of each of the refrigerant pipelines 20 is abutted against the outer surface of the liner 100. The working process of the semiconductor refrigerator is as follows: when the semiconductor cooler is powered on and operates, the temperature of the cold end decreases, the temperature of the cold end heat exchanging part 10 correspondingly decreases due to the conduction, and the gaseous refrigerant therein undergoes phase change to be condensed when subjected to cold, to change into the liquid refrigerant at a low temperature; and the liquid refrigerant flows down due to gravity along the cavity of the refrigerant pipeline 20, and the condensed flown-down refrigerant is heated, undergoes phase change and is evaporated in the refrigerant pipeline 20 since it absorbs heat from the interior of the refrigerator to change into a gaseous state. The gaseous vapour will rise under the driving of the pressure of a heat source, and the gaseous refrigerant will rise to the cold end heat exchanging part 10 to continue to condense, thereby repeating the refrigeration, resulting in the lowered temperature of the storage compartment so that the cooling is achieved.

In some embodiments of the present invention, the evaporation sections 21 of some refrigerant pipelines 20 of the plurality of refrigerant pipelines 20 are arranged in a third plane parallel to the first plane such that two side walls and a rear wall of the liner 100 respectively perform heat exchange with the evaporation sections 21 of the corresponding refrigerant pipelines 20. Specifically, the evaporation section 21 of each of the refrigerant pipelines 20, of which the evaporation sections 21 are arranged in the second plane, is located between the first plane and the third plane. The evaporation section 21 of each of the refrigerant pipelines 20, of which the evaporation sections 21 are arranged in the first plane, and the evaporation section 21 of each of the refrigerant pipelines 20, of which the evaporation sections 21 are arranged in the third plane, are both located on one side of the second plane.

In order to ensure that the interior of the liner 100 of the semiconductor refrigerator is cooled relatively evenly, the number of refrigerant pipelines 20, of which the evaporation sections 21 are arranged in the second plane, is two, and the refrigerant pipelines are symmetrically arranged with respect to a vertical geometrical symmetry plane. The number of refrigerant pipelines 20, of which the evaporation sections 21 are arranged in the first plane, and the number of refrigerant pipelines 20, of which the evaporation sections 21 are arranged in the third plane, are both one, and the refrigerant pipelines are symmetrically arranged with respect to the vertical geometrical symmetry plane, wherein the vertical geometrical symmetry plane is the vertical symmetry plane of the liner 100. Further, the evaporation section 21 of each of the refrigerant pipelines 20, of which the evaporation sections 21 are arranged in the second plane, has a projected length W2 on a horizontal plane that is smaller than ½ of the width Wr of the rear wall of the liner 100 of the semiconductor refrigerator and greater than ¼ of the width Wr of the rear wall of the liner 100, so that the evaporation sections 21 of the two refrigerant pipelines 20 are thermally connected to the left and right half portions of the outer surface of the rear wall of the liner 100, respectively. The evaporation section 21 of each of the refrigerant pipelines 20, of which the evaporation sections 21 are arranged in the first plane, and the evaporation section 21 of each of the refrigerant pipelines 20, of which the evaporation sections 21 are arranged in the third plane, both have a projected length (W1 and W3 respectively) on a horizontal plane that is smaller than the width Ws of the side wall of the liner 100 of the semiconductor refrigerator and greater than ½ of the width Ws of the side wall of the liner 100, so that the evaporation sections 21 of the two refrigerant pipelines 20 are thermally connected to the outer surfaces of the two side walls of the liner 100, respectively.

In order to better transfer the cold of each evaporation section 21 to the liner 100 of the refrigerator, the thermal connection between the evaporation section 21 of each refrigerant pipeline 20 and the outer surface of the liner 100 is achieved by abutting the evaporation sections 21 of the refrigerant pipelines 20 against the outer surfaces of the rear wall and the two side walls of the liner 100, respectively. In some alternative embodiments of the present invention, each evaporation section 21 may be abutted against a respective flat thermally conductive plate, and the flat thermally conductive plates are abutted against the rear wall and the two side walls of the liner 100, so that the liner 100 of the refrigerator is cooled more evenly.

Figure 3:
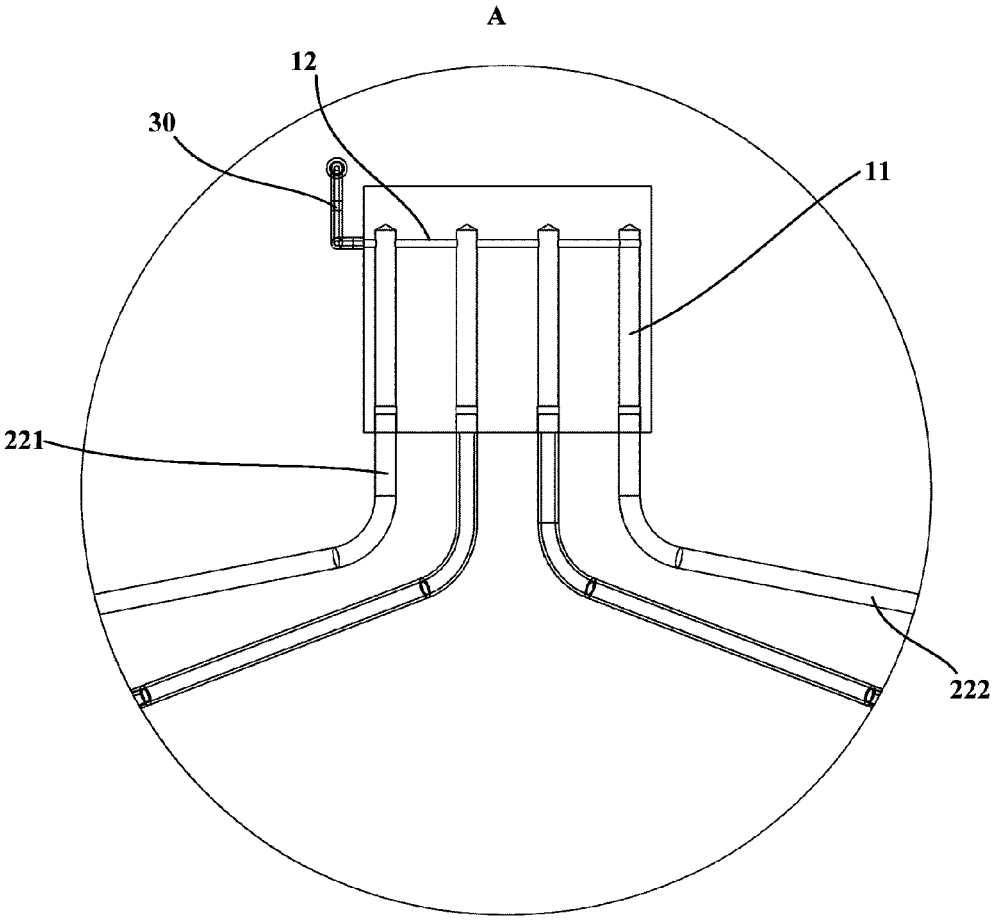
FIG. 3 is a schematic partial enlarged view of A in FIG. 1.

In some embodiments of the present invention, each of the refrigerant pipelines 20 may be selected from a copper tube, a stainless steel tube, an aluminum tube, etc., preferably a copper tube. As shown in FIG. 3, the connection section 22 of the refrigerant pipeline 20, of which the evaporation section 21 is thermally connected to the side wall of the liner 100, may comprise a first segment 221 and a second segment 222, wherein the first segment 221 is in communication with the inner cavity or conduit of the cold end heat exchanging part 10 and extends to the outside of the cold end heat exchanging part 10; and the second segment 222 is connected to the first segment 221, extends transversely and obliquely downwardly on the rear wall of the liner 100, and then is obliquely downwardly bent forwards to the side wall of the liner 100 to connect the evaporation section 21 of the corresponding refrigerant pipeline 20. The connection section 22 of the refrigerant pipeline 20, of which the evaporation section 21 is thermally connected to the rear wall of the liner 100, may include only the first segment 221.

The evaporation section 21 of each refrigerant pipeline 20 may include a plurality of vertically spaced straight pipe segments 211 and bent segments 212, each bent segment being used for connecting two adjacent straight pipe segments 211, wherein each of the straight pipe segments 211 is arranged obliquely at an angle of 10° to 70° with respect to the horizontal plane, to ensure that the liquid refrigerant is free to flow therein by gravity, and the bent segment 212 is preferably arranged in a "C" shape or is an arc-shaped section so that the evaporator section 21 is generally of an inclined "Z"-shaped structure.

The semiconductor refrigerator of the embodiments of the present invention further comprises a plurality of retention steel wires 50 in order to prevent deformation of the evaporation section 21 of each of the refrigerant pipelines 20 to ensure efficient flow and heat exchange of the refrigerant within each of the refrigerant pipelines 20. Each of the retention steel wires 50 is disposed in the vertical direction. A pipe wall at an outer vertex (also referred to as a top hump) of each of the bent segments 212 on the same side of each of the refrigerant pipelines 20 is welded to a corresponding retention steel wire 50. Specifically, the two retention steel wires 50 may be respectively fixed to two sides of the evaporation section 21 of a corresponding refrigerant pipeline 20, and each of the retention steel wires 50, at different locations along its length, is successively fixed to the top hump of each of the bent segments 212 on the corresponding side of the corresponding evaporation section 21. Further, other portions of each of the refrigerant pipelines 20 that are in contact with the respective retention steel wire 50 may be all welded to the retention steel wire 50.

In the embodiment of the present invention, as shown in FIG. 3, the cold end heat exchanging part 10 of the cold end heat exchanging device 200 may be a heat exchange copper block in which four stepped blind holes 11 extending in the vertical direction and a horizontal tube hole 12 communicating with the upper portion of each of the step blind holes 11 are provided to form a pipeline inside the cold end heat exchanging part 10. The upper end of each of the refrigerant pipelines 20 can be inserted into the corresponding stepped blind hole 11. The cold end heat exchanging device 200 further comprises a refrigerant pouring tube 30 having one end being in communication with the corresponding horizontal tube hole 12 and the other end being operatively open the normally closed end to receive the refrigerant poured from the outside, so as to pour the refrigerant into each of the refrigerant pipelines 20.

In some alternative embodiments of the present invention, the cold end heat exchanging part 10 of the cold end heat exchanging device 200 may be a cold end heat exchange box which defines an inner cavity or conduit for containing a refrigerant existing in both gas and liquid phases and is configured to allow the refrigerant to undergo phase-change heat exchange. The connection section 22 of each of the refrigerant pipelines 20 is in communication with the lower portion of the inner cavity. The cold end heat exchanging device 200 may be further provided with a three-way device for pouring the refrigerant. The three-way device is located on the connection section 22 of one refrigerant pipeline 20 with the first and second ends thereof being used to communicate the corresponding two segments of the connection section 22 and the third end being configured to operatively open the normally closed end to receive the refrigerant poured from the outside. The use of the three-way device reduces the difficulty of the process of pouring the refrigerant and provides a means for maintaining.

Figure 4:
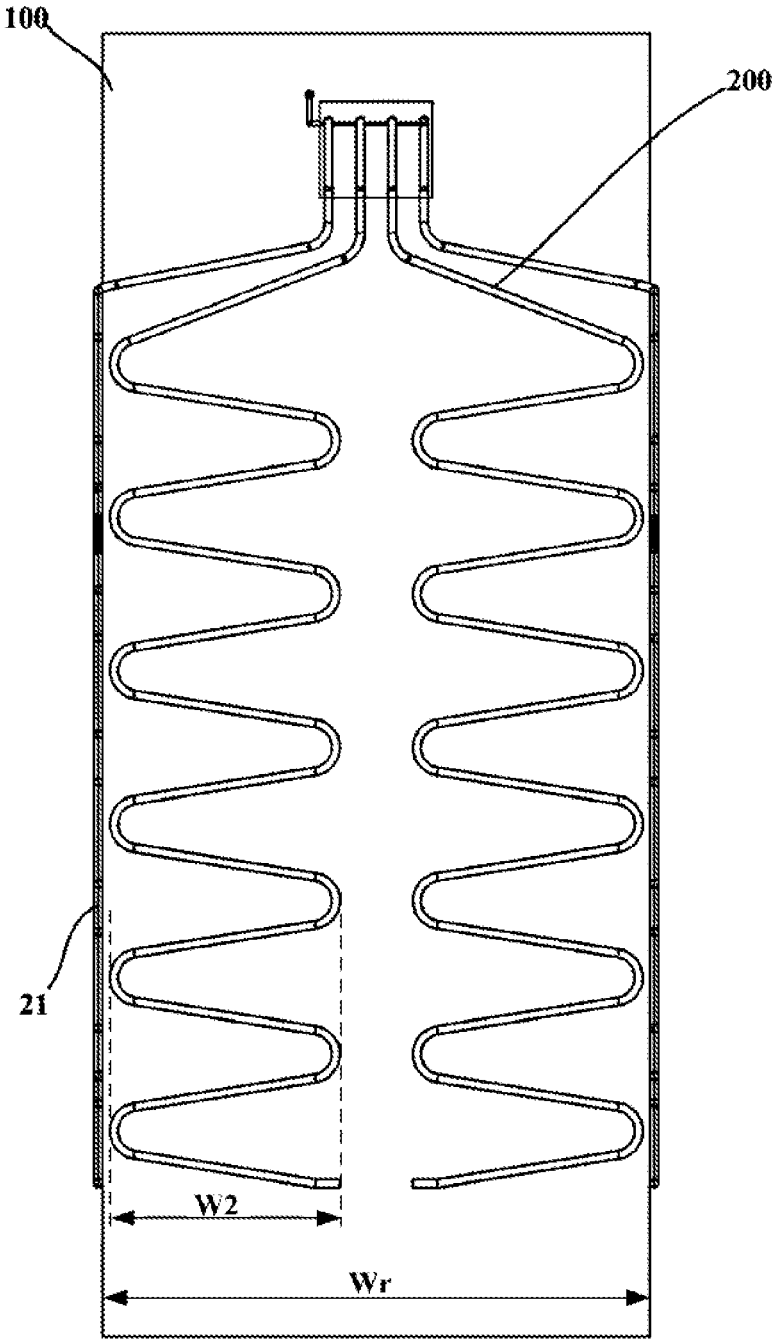
FIG. 4 is a schematic rear view of a partial structure of a semiconductor refrigerator according to one embodiment of the present invention.
Figure 5:
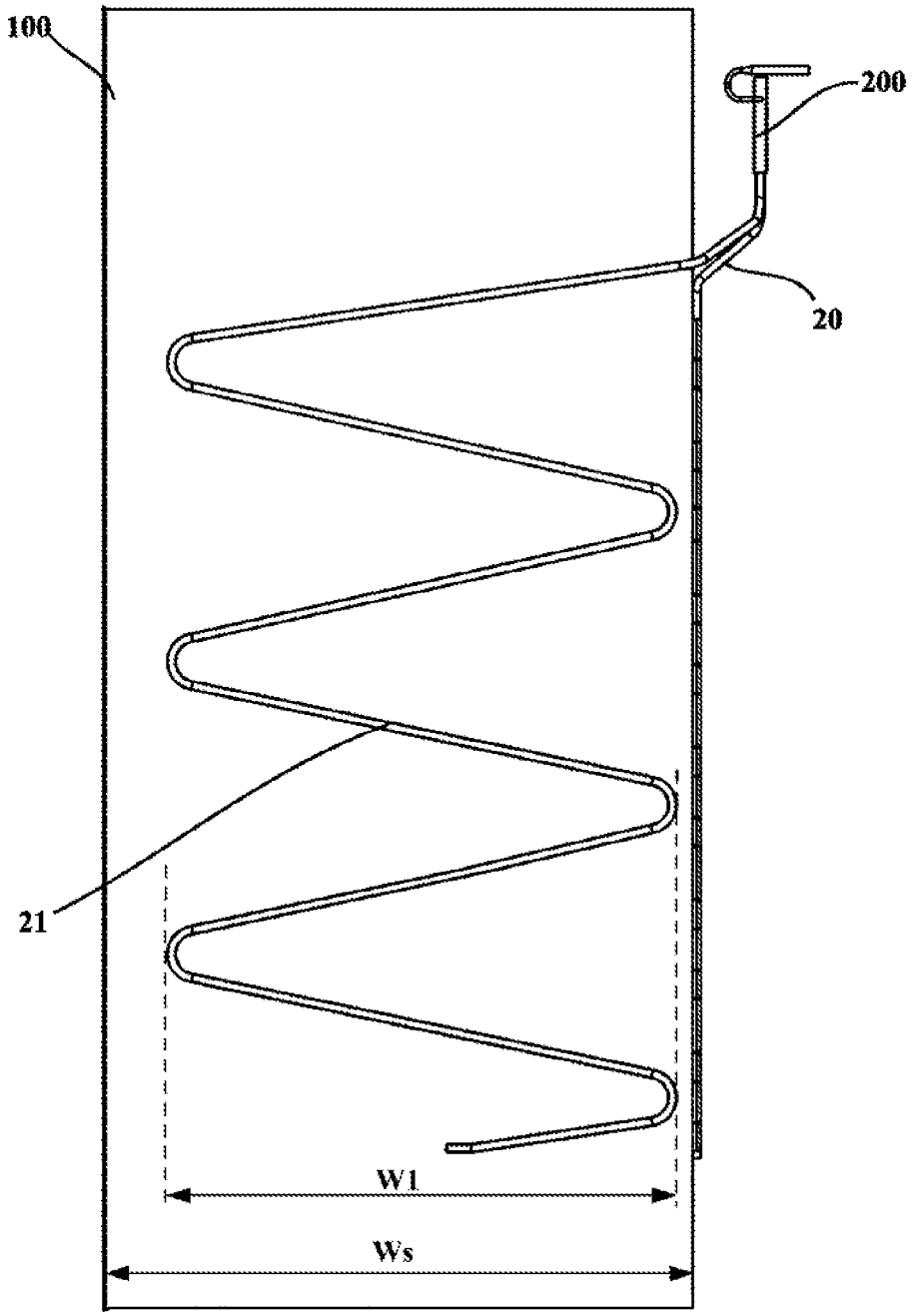
FIG. 5 is a schematic right view of a partial structure of a semiconductor refrigerator according to one embodiment of the present invention.

The embodiments of the present invention further provide a semiconductor refrigerator. As shown in FIGS. 4 and 5, the semiconductor refrigerator may comprise: a liner 100, a semiconductor cooler, and a cold end heat exchanging device 200 in any of the above embodiments. The liner 100 has a storage compartment defined therein. The semiconductor cooler may be provided at the rear of the liner 100. Specifically, the cold end heat exchanging device 200 may be mounted in such a way that the rear surface of the cold end heat exchanging part 10 thereof is thermally connected to a cold end of the semiconductor cooler, and the evaporation section 21 of each of the refrigerant pipelines 20 is abutted against the outer surface of the inner 100 for transferring the cold from the cold end to the storage compartment.

The structure of the cabinet of the semiconductor refrigerator generally further comprises: a housing, a door 500 and an insulation layer. There are two types of refrigerator cabinet structures, one is of an assembled type, that is, an integrated cabinet assembled by a top cover, a back 310, left and right side plates 320, an underlying plate, etc. The other is of a monolithic type, that is, the top cover and the left and right side plates 320 are rolled into a "U" shape as required, which is referred to as a U-shell, and are spot welded with the back 310 and the underlying plate of the housing to form the cabinet. The semiconductor refrigerator of the embodiment of the present invention preferably uses the monolithic housing, that is, the housing includes a U-shell and a back 310, wherein the U-shell is disposed on the outer sides of the side walls and the top wall of the liner 100, and the back 310 of the housing and the rear wall of the liner 100 defines an installation space. The semiconductor cooler and the cold end heat exchanging device 200 may be selectively arranged in the installation space defined by the outer side of the rear wall of the liner 100 and the back 310 of the housing, and the front surface of the cold end heat exchanging part 10 is opposed to the rear wall of the liner 100. A distance may be provided between the front surface of the cold end heat exchanging part 10 and the rear wall of the liner 100 to ensure that the heat of a hot end is not conducted to the liner 100 during a power failure or an operational failure, causing an abnormal temperature.

Figure 6:
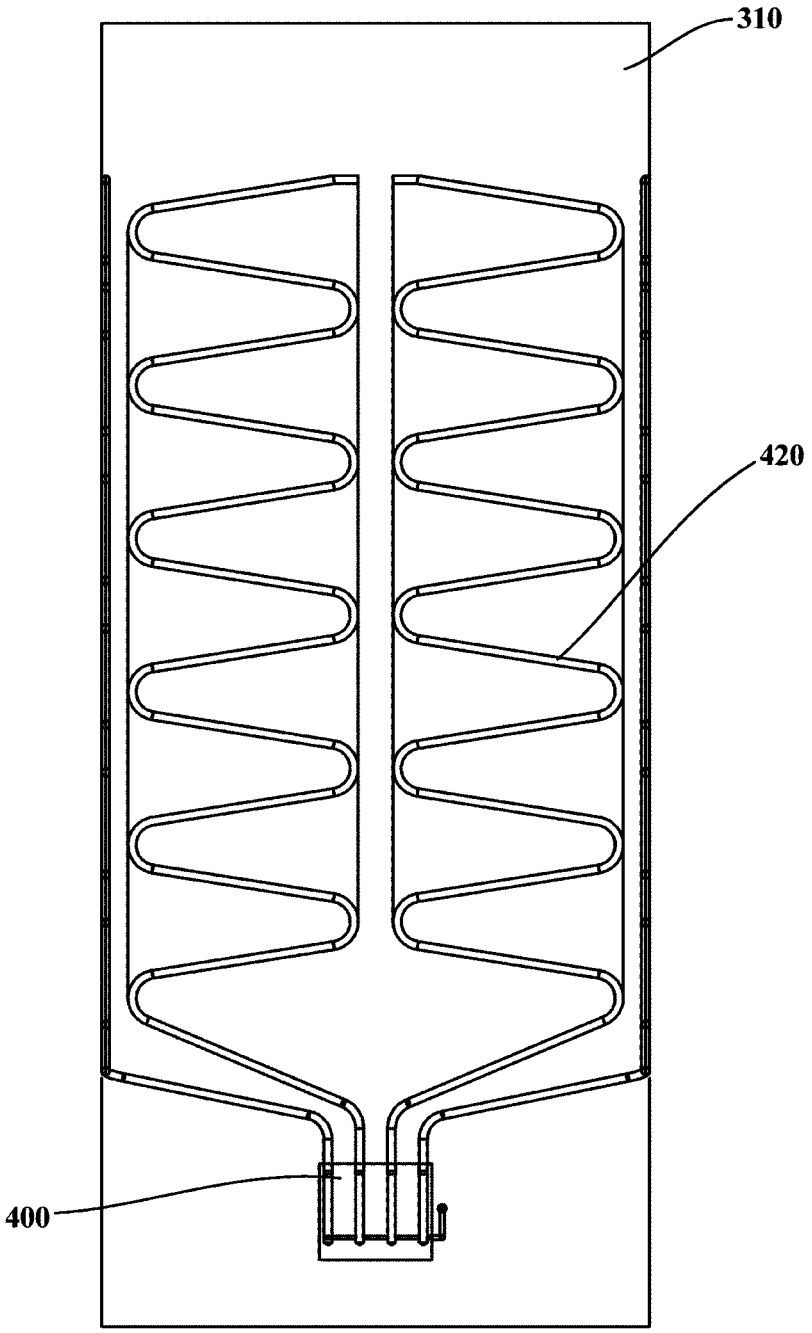
FIG. 6 is a schematic front view of a partial structure of a semiconductor refrigerator according to one embodiment of the present invention.
Figure 7:
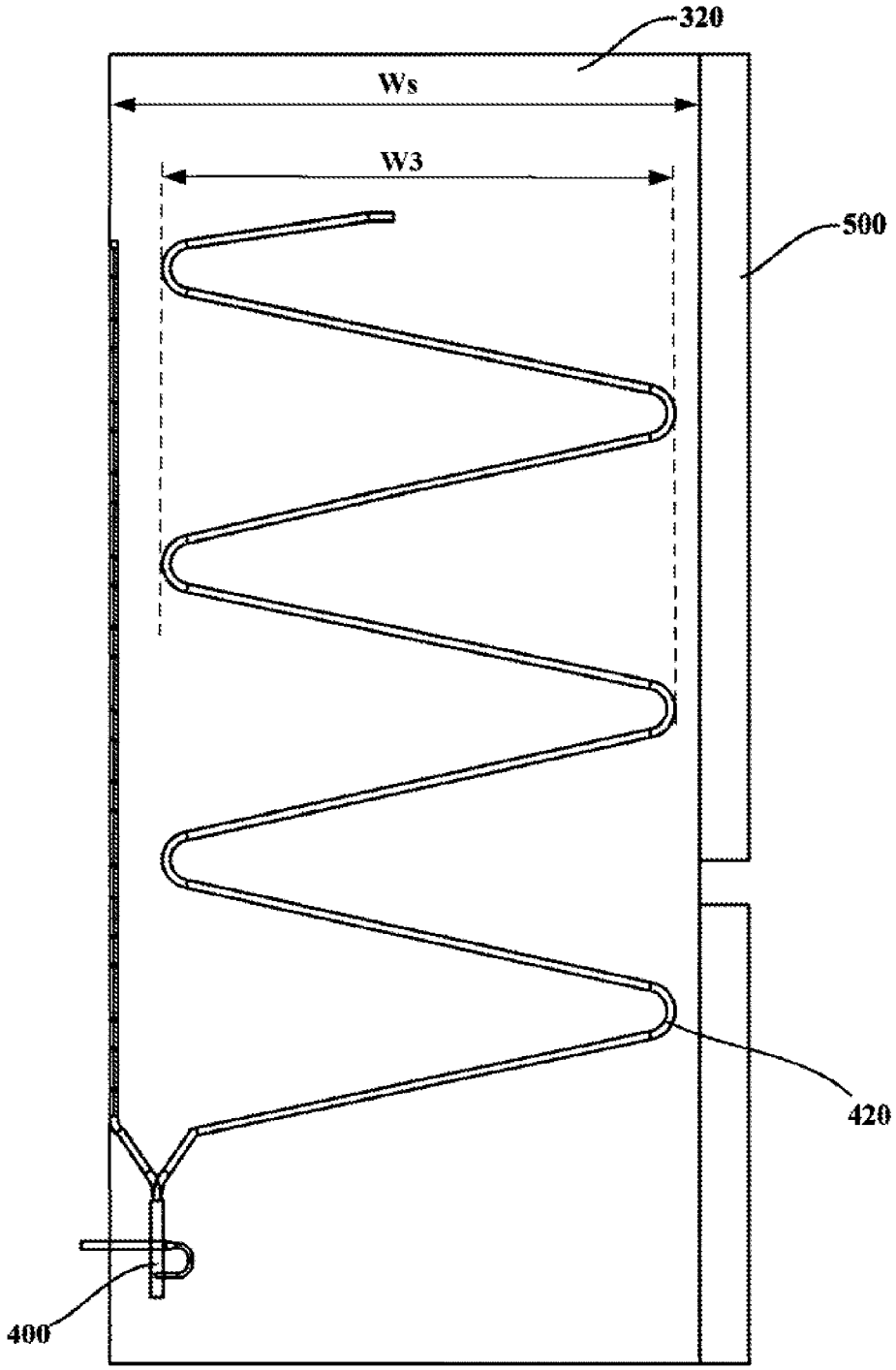
FIG. 7 is a schematic sectional view of a partial structure of a semiconductor refrigerator according to one embodiment of the present invention.

In order to solve the heat dissipation problem of the hot end of the semiconductor cooler, the semiconductor refrigerator of this embodiment may further comprise a hot end heat exchanging device 400, which is thermally connected to the hot end of the semiconductor cooler for diffusing the heat generated by the hot end to the surrounding environment. As shown in FIGS. 6 and 7, the hot end heat exchanging device 400 comprises a hot end heat exchanging part and a heat dissipation pipeline 420. The hot end heat exchanging part defines an inner cavity for containing a refrigerant existing in both gas and liquid phases and configured to allow the refrigerant to undergo phase-change heat exchange. The heat dissipation pipeline 420 is configured to allow the refrigerant to flow therein and undergo phase-change heat exchange, and the first end of each heat dissipation pipeline 420 that forms the opening end is connected to the upper portion of the inner cavity of the hot end heat exchanging part, and each heat dissipation pipeline 420 obliquely upwardly bent and extends from the first end thereof and terminates at the second end forming the closed end. Some of pipe sections of the heat dissipation pipeline 420 may be abutted against the inner surface of the housing of the refrigerator, such as some of pipe sections of some of the heat dissipation pipelines 420 are abutted against the inner surface of the back 310 of the housing, and some of pipe sections of the remaining heat dissipation pipelines 420 are abutted against the inner surfaces of the two side plates 320 of the housing, such that the housing is used to diffuse heat to the surrounding environment. The refrigerant poured in the hot end heat exchanging part may be water or other refrigerant, the state of which is a co-existing state of gas and liquid phases, and the temperature of the hot end of the semiconductor cooler rises when being powered on and working. The hot end of the hot refrigerant performs heat exchange with the hot end heat exchanging part, the hot end heat exchanging part forms an evaporator for changing the refrigerant to be in a gaseous state, the gaseous refrigerant rises up along the refrigerant pipeline 20 under the pressure of the heat source, to transfer the heat to the housing of the refrigerator, then the heat is transferred to the external space through the natural convection, the heat dissipation pipeline 420 forms a condenser, and the refrigerant is condensed into the liquid state after release of heat, flows back to the hot end heat exchanging part by gravity, and re-absorbs the heat from the hot end to evaporate same to form a thermal cycle.

When the hot end heat exchanging device 400 is assembled with the cold end heat exchanging device 200 described in the above embodiments, the structure thereof may be such that the semiconductor cooler is arranged in the space between the rear wall of the liner 100 of the refrigerator and the back 310 of the housing of the refrigerator, the rear wall of the cold end heat exchanging part of the cold end heat exchanging device 200 is connected to the cold end of the semiconductor cooler, and the refrigerant pipeline 20 is abutted against the liner 100 of the refrigerator for cooling the storage cavity. The hot end of the semiconductor cooler conducts the heat from the hot end to a lower position through a vertically downwardly arranged heat bridge device, and the upper end of the heat bridge device is connected to the hot end of the semiconductor cooler, the hot end heat exchanging part of the hot end heat exchanging device 400 can be thermally connected to the hot end of the semiconductor cooler via the lower end of the heat bridge device to provide a greater upwardly extending space for the heat dissipation pipeline 420. In some alternative embodiments of the present invention, other forms of the hot end heat exchanging device 400 may also be used by those skilled in the art, for example, using a hot end heat exchanging device 400 comprising a heat pipe, a fin and a fan.

At this point, those skilled in the art will recognize that, while numerous exemplary embodiments of the present invention have been shown and described in detail herein, many other variations or modifications that conform to the principles of the present invention may be determined or derived directly from the disclosure of the present invention without departing from the spirit and scope of the present invention. It therefore should be understood and determined that the scope of the present invention covers all such other modifications or modifications.

What is claimed is:

1. A cold end heat exchanging device for a semiconductor refrigerator, comprising:

a cold end heat exchanging part which defines an inner cavity or conduit for containing a refrigerant existing in both gas and liquid phases and the cold end heat exchanging part is configured to allow the refrigerant to flow therein and undergo phase-change heat exchange; and a plurality of refrigerant pipelines configured to allow the refrigerant to flow therein and undergo phase-change heat exchange, each of the refrigerant pipelines being provided with: an evaporation section which is bent to point in a first direction and extends in a vertical plane and has a closed tail end, and a connection section which is bent to point in a second direction opposite to the first direction and extends from a starting end of the evaporation section and is connected to the inner cavity or conduit; and the evaporation sections of at least some of the plurality of refrigerant pipelines being arranged in two vertical planes which are perpendicular to each other, wherein the two vertical planes include a first plane perpendicular to the rear surface of the cold end heat exchanging part, and a second plane parallel to the rear surface of the cold end heat exchanging part;

wherein the evaporation sections of some of the plurality of refrigerant pipelines are arranged in a third plane parallel to the first plane;

wherein the evaporation section of each of the refrigerant pipelines, of which the evaporation sections are arranged in the second plane, is located between the first plane and the third plane;

wherein the evaporation section of each of the refrigerant pipelines comprises:

a plurality of straight pipe segments disposed in the vertical direction at intervals, each of the straight pipe segments being arranged obliquely at an angle of 10° to 70° with respect to the horizontal plane; and bent segments, each connecting two adjacent straight pipe segments, wherein the bent segments are arc-shaped sections.

2. The cold end heat exchanging device according to claim 1, characterized in that the cold end heat exchanging part has a rectangular cuboid shape with the areas of a front surface and a rear surface opposite each other being larger than the areas of other surfaces, and the rear surface of the cold end heat exchanging part serves as a heat exchange surface which is thermally connected to a cold source.

3. The cold end heat exchanging device according to claim 1, characterized in that the evaporation section of each of the refrigerant pipelines, of which the evaporation sections are arranged in the first plane, and the evaporation section of each of the refrigerant pipelines, of which the evaporation sections are arranged in the third plane, are both located on one side of the second plane.

4. The cold end heat exchanging device according to claim 3, characterized in that the number of refrigerant pipelines, of which the evaporation sections are arranged in the second plane, is two, and the refrigerant pipelines are symmetrically arranged with respect to a vertical geometrical symmetry plane.

5. The cold end heat exchanging device according to claim 4, characterized in that the number of refrigerant pipelines, of which the evaporation sections are arranged in the first plane, and the number of refrigerant pipelines, of which the evaporation sections are arranged in the third plane, are both one, and the refrigerant pipelines are symmetrically arranged with respect to the vertical geometrical symmetry plane.

6. The cold end heat exchanging device according to claim 5, characterized in that the evaporation section of each of the refrigerant pipelines, of which the evaporation sections are arranged in the second plane, has a projected length on a horizontal plane that is smaller than ½ of the width of a rear wall of a liner of the semiconductor refrigerator and greater than ¼ of the width of the rear wall of the liner;

the evaporation section of each of the refrigerant pipelines, of which the evaporation sections are arranged in the first plane, and the evaporation section of each of the refrigerant pipelines, of which the evaporation sections are arranged in the third plane, both have a projected length on a horizontal plane that is smaller than the width of a side wall of the liner of the semiconductor refrigerator and greater than ½ of the width of the side wall of the liner.

7. The cold end heat exchanging device according to claim 1, further comprises:

a plurality of retention steel wires disposed in the vertical direction; and a pipe wall at an outer vertex of each of the bent segments on the same side of each of the refrigerant pipelines is welded to one of the retention steel wires.

8. A semiconductor refrigerator, comprising:

a liner having a storage compartment defined therein;

a semiconductor cooler disposed behind the liner; and a cold end heat exchanging device comprising:

a cold end heat exchanging part which defines an inner cavity or conduit for containing a refrigerant existing in both gas and liquid phases and the cold end heat exchanging part is configured to allow the refrigerant to flow therein and undergo phase-change heat exchange; and a plurality of refrigerant pipelines configured to allow the refrigerant to flow therein and undergo phase-change heat exchange, each of the refrigerant pipelines being provided with: an evaporation section which is downwardly bent and extends in a vertical plane and has a closed tail end, and a connection section which is upwardly bent and extends from a starting end of the evaporation section and is connected to the inner cavity or conduit; and the evaporation sections of at least some of the plurality of refrigerant pipelines being arranged in two vertical planes which are perpendicular to each other, wherein the two vertical planes include a first plane perpendicular to the rear surface of the cold end heat exchanging part, and a second plane parallel to the rear surface of the cold end heat exchanging part;

wherein the evaporation sections of some of the plurality of refrigerant pipelines are arranged in a third plane parallel to the first plane;

wherein the evaporation section of each of the refrigerant pipelines, of which the evaporation sections are arranged in the second plane, is located between the first plane and the third plane;

wherein the evaporation section of each of the refrigerant pipelines comprises:

a plurality of straight pipe segments disposed in the vertical direction at intervals, each of the straight pipe segments being arranged obliquely at an angle of 10° to 70° with respect to the horizontal plane; and bent segments, each connecting two adjacent straight pipe segments, wherein the bent segments are arc-shaped sections;

wherein the cold end heat exchanging device is mounted such that the rear surface of the cold end heat exchanging part thereof is thermally connected to a cold end of the semiconductor cooler, and the evaporation section of each of the refrigerant pipelines is abutted against an outer surface of the inner for transferring the cold from the cold end to the storage compartment.

* * * * *